US008652721B2

(12) United States Patent
Ishii

(10) Patent No.: US 8,652,721 B2
(45) Date of Patent: Feb. 18, 2014

(54) TONER, DEVELOPER, AND METHOD OF MANUFACTURING TONER

(75) Inventor: Masayuki Ishii, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 133 days.

(21) Appl. No.: 13/359,038

(22) Filed: Jan. 26, 2012

(65) Prior Publication Data

US 2012/0237867 A1 Sep. 20, 2012

(30) Foreign Application Priority Data

Mar. 14, 2011 (JP) ..... 2011-055877

(51) Int. Cl.
*G03G 9/087* (2006.01)

(52) U.S. Cl.
USPC ..... 430/108.2; 430/108.1; 430/137.14; 430/137.1; 430/108.7

(58) Field of Classification Search
USPC ..... 430/108.7, 108.1, 137.14, 137.1, 108.2
See application file for complete search history.

(56) References Cited

U.S. PATENT DOCUMENTS

| | | | | |
|---|---|---|---|---|
| 2005/0244449 | A1 * | 11/2005 | Sayer et al. | 424/422 |
| 2010/0310980 | A1 | 12/2010 | Sugimoto et al. | |
| 2011/0136051 | A1 * | 6/2011 | Ishii et al. | 430/105 |

FOREIGN PATENT DOCUMENTS

| | | | | |
|---|---|---|---|---|
| CN | 101907838 | A | | 12/2010 |
| JP | 2002137914 | A | * | 5/2002 |
| JP | 2006-282446 | A | | 10/2006 |
| JP | 2007-156099 | | | 6/2007 |
| JP | 2007-248911 | | | 9/2007 |
| JP | 2007-296463 | | | 11/2007 |
| WO | WO 2010079316 | A1 | * | 7/2010 |

OTHER PUBLICATIONS

Palard, M et al. "Synthesis of silicated hydroxapatite Ca10(PO4)6-x(SiO4)x(Oh)2-x" Journal of Solid State Chemsitry 181 (2008) pp. 1950-1960.*

* cited by examiner

*Primary Examiner* — Christopher Rodee
(74) *Attorney, Agent, or Firm* — Oblon, Spivak, McClelland, Maier & Neustadt, L.L.P.

(57) ABSTRACT

A toner is provided including a mother particle and an external additive covering the surface of the mother particle. The mother particle includes a binder resin and a release agent. The external additive includes a hydroxyapatite silica complex porous particle having a number average particle diameter of 160 nm or less.

14 Claims, 1 Drawing Sheet

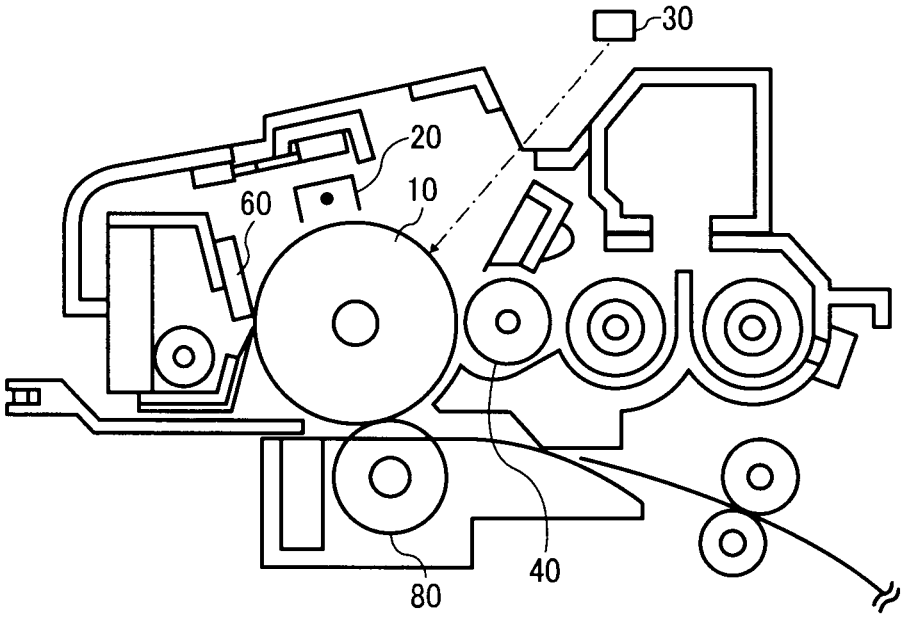
30
20
10
60
40
80

TONER, DEVELOPER, AND METHOD OF MANUFACTURING TONER

CROSS-REFERENCE TO RELATED APPLICATIONS

This patent application is based on and claims priority pursuant to 35 U.S.C. §119 to Japanese Patent Application No. 2011-055877, filed on Mar. 14, 2011, in the Japanese Patent Office, the entire disclosure of which is hereby incorporated herein by reference.

FIELD OF THE INVENTION

The present invention relates to a toner and a developer for use in electrophotography. The present invention also relates to a method of manufacturing toner.

BACKGROUND OF THE INVENTION

A typical electrophotographic method includes an electrostatic latent image forming process in which an electrostatic latent image is formed on a photoreceptor including a photoconductive substance; a developing process in which the electrostatic latent image is developed into a toner image with a toner; a transfer process in which the toner image is transferred onto a transfer material such as paper; a fixing process in which the toner image is fixed on the transfer material by application of heat, pressure, and/or solvent vapor; and a cleaning process in which residual toner particles remaining on the photoreceptor are removed. The electrostatic latent image forming process further includes a charging process in which a charger uniformly charges a surface of the photoreceptor (e.g., an organic photoconductor (OPC)) prior to formation of an electrostatic latent image.

In particular, the photoreceptor is typically charged by a corona charger. Corona discharge is a continuous discharge phenomenon caused by the occurrence of local insulation breakdown of the air in a nonuniform electric field. A typical corona charger has a configuration such that a wire having a very small diameter is stretched taut within an aluminum shield case, a part of which is eliminated so that corona ions are discharged therefrom. As the wire is supplied with an increasing voltage, a strong electric field is locally formed around the wire and insulation breakdown of the air locally occurs, resulting in corona discharge.

The corona charger generally produces discharge products that degrade the resulting image quality. Specifically, when the photoreceptor is left as it stands after a long-term discharge of the corona charger, the resulting image density may be non-uniform at a portion on the photoreceptor immediately below the corona charger. This is because discharge products are accumulated on inner walls of the corona charger while image formation is occurring and they gradually contaminate the photoreceptor while image formation is not occurring, and as a result, a surface potential difference occurs between a portion immediately below the corona charger and the other portions on the image bearing member.

For the purpose of effectively removing discharge products accumulating on a photoreceptor, one proposed approach involves adding fine abrasive particles to the surface of toner. However, when coarse abrasive particles are excessively present, the photoreceptor may be excessively abraded or scratched and defective images may be produced.

When the content or particle size of the fine abrasive particles is too small, discharge products cannot be sufficiently removed from the photoreceptor or the surface of the photoreceptor cannot be sufficiently refreshed.

Japanese Patent Application Publication No. 2007-156099 proposes fine particles for covering toner surfaces. Such fine particles have an average primary particle diameter of several to several tens nanometer. Hydrophobized silica particles and hydrophobized titanium oxide particles are preferred for the fine particles. As another example, Japanese Patent Application Publication No. 2007-248911 proposes organic fine particles for covering toner surfaces.

SUMMARY OF THE INVENTION

Exemplary aspects of the present invention are put forward in view of the above-described circumstances, and provide a novel toner that prevents image deterioration for an extended period of time and a method of producing such a toner.

According to an embodiment, a toner includes a mother particle and an external additive covering the surface of the mother particle. The mother particle includes a binder resin and a release agent. The external additive includes a hydroxyapatite silica complex porous particle having a number average particle diameter of 160 nm or less.

According to another embodiment, a method of producing toner includes: dissolving or dispersing toner components, including a binder resin or a precursor thereof and a release agent, in an organic solvent to prepare a toner components liquid; dispersing the toner components liquid in an aqueous medium to prepare an emulsion; removing the organic solvent from the emulsion to prepare a mother particle; and covering a surface of the mother particle with an external additive, the external additive including a hydroxyapatite silica complex porous particle having a number average particle diameter of 160 nm or less.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIGURE illustrates a process cartridge according to an embodiment.

DETAILED DESCRIPTION OF THE INVENTION

A toner according to an embodiment includes a mother particle and an external additive that is covering the surface of the mother particle. The mother particle includes a binder resin and a release agent. The external additive includes a hydroxyapatite silica complex porous particle having a number average particle diameter of 160 nm or less. The hydroxyapatite silica complex porous particle effectively adsorbs or removes discharge products accumulating on a photoreceptor without excessively abrading the photoreceptor. Thus, the surface of the photoreceptor can keep reliable chargeability for an extended period of time. The hydroxyapatite silica complex porous particle can be prepared by, for example, reacting a calcium silicate with a phosphoric acid so as to convert a calcium component and a silica component into a crystalline hydroxyapatite and a porous silica, respectively.

In another embodiment, the toner includes a mother particle formed by emulsifying or dispersing a toner components liquid (oily phase), prepared by dissolving or dispersing toner components including a binder resin and/or binder resin precursor and a release agent in an organic solvent, in an aqueous medium (aqueous phase) and removing the organic solvent therefrom, and a surface of the mother particle is covered with an external additive including one or more kinds of materials including the hydroxyapatite silica complex porous particle.

In another embodiment, the binder resin and/or binder resin precursor include a modified polyester having an ester bond and another bond other than an ester bond or a resin precursor capable of producing the modified polyester, and a crystalline polyester; and the external additive includes the hydroxyapatite silica complex porous particle.

In another embodiment, the content (weight ratio) of the hydroxyapatite silica complex porous particle is 0.1% to 5% based on total weight of the mother particle.

In another embodiment, the resin precursor capable of producing the modified polyester includes a compound having an active hydrogen group and a polyester having a functional group reactive with the active hydrogen group of the compound.

In another embodiment, the modified polyester includes an ester bond and a urea bond.

In another embodiment, the mother particle has a long axis dispersion diameter of 0.2 μm to 3.0 μm and a ratio of the long axis dispersion diameter to a short axis dispersion diameter is 3 or more.

In another embodiment, an endothermic peak temperature of the crystalline polyester measured by a differential scanning calorimetry (DSC) is 50° C. to 150° C.

In another embodiment, the crystalline polyester is obtained by a reaction between an alcohol component and an acid component, the alcohol component includes at least one of 1,4-butanediol, 1,6-hexanediol, 1,8-octanediol, 1,10-decanediol, and 1,12-dodecanediol, and the acid component includes at least one dicarboxylic acid selected from fumaric acid, 1,4-butanedioic acid, 1,6-hexanedioic acid, 1,8-octanedioic acid, 1,10-decanedioic acid, and 1,12-dodecanedioic acid.

In another embodiment, the mother particle has a volume average particle diameter (Dv) of not less than 3.0 μm and less than 6.0 μm.

In another embodiment, the ratio (Dv/Dn) of the volume average particle diameter (Dv) to a number average particle diameter (Dn) of the mother particle is 1.05 to 1.25.

In another embodiment, a method of manufacturing the toner includes a process of preparing a toner components liquid (oily phase) by dissolving or dispersing toner components including a binder resin and/or binder resin precursor and a release agent in an organic solvent, and a process of forming a mother particle by emulsifying or dispersing the oily phase in an aqueous medium (aqueous phase) and removing the organic solvent therefrom.

Another embodiment includes a developer comprising the toner.

Another embodiment includes a developer comprising the toner and a carrier.

Pores (void parts) in a porous material express hydrophobicity. Thus, the hydroxyapatite silica complex porous particle is regarded as having hydrophobic sites, and expresses a greater hydrophobicity than a homogeneous silica particle. Owing to the inherent hydrophobicity, the hydroxyapatite silica complex porous particle needs not be surface-treated even when used for an external additive of electrophotographic toners.

Specific examples of usable binder resins include, but are not limited to, homopolymers of styrene or styrene derivatives (e.g., polystyrene, poly(p-chlorostyrene), polyvinyl toluene), styrene-based copolymers (e.g., styrene-p-chlorostyrene copolymer, styrene-propylene copolymer, styrene-vinyltoluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleate copolymer), polymethyl methacrylate, polybutyl methacrylate, polyvinyl chloride, polyvinyl acetate, polyethylene, polyester, polyurethane, epoxy resin, polyvinyl butyral, polyacrylic acid, rosin, modified rosin, terpene resin, phenol resin, aliphatic or aromatic hydrocarbon resin, and aromatic petroleum resin. Two or more of these resins can be used in combination.

Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Two or more of these colorants can be used in combination. In some embodiments, the content of the colorant in the mother particle is 1 to 15% by weight or 3 to 10% by weight.

The colorant can be combined with a resin to be used as a master batch. Specific examples of usable resins for the master batch include, but are not limited to, homopolymers of styrene or styrene derivatives, styrene-based copolymers, polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid, rosin, modified rosin, terpene resin, aliphatic or alicyclic hydrocarbon resin, aromatic petroleum resin, chlorinated paraffin, and paraffin wax. Two or more of these resins can be used in combination.

Specific examples of usable release agents include, but are not limited to, waxes. Specific examples of usable waxes include, but are not limited to, carbonyl-group-containing waxes, polyolefin waxes, and long-chain hydrocarbons. Two or more of these waxes can be used in combination.

Specific examples of the carbonyl-group-containing waxes include, but are not limited to, polyalkanoic acid esters, polyalkanol esters, polyalkanoic acid amides, polyalkyl amides, and dialkyl ketones. Specific examples of the polyalkanoic acid esters include, but are not limited to, carnauba wax, montan wax, trimethylolpropane tribehenate, pentaerythritol tetrabehenate, pentaerythritol diacetate dibehenate, glycerin tribehenate, 1,18-octadecanediol distearate. Specific examples of the polyalkanol esters include, but are not limited to, tristearyl trimellitate and distearyl maleate. Specific examples of the polyalkanoic acid amides include, but are not limited to, dibehenylamide. Specific examples of the polyalkyl amides include, but are not limited to, trimellitic acid tristearylamide. Specific examples of the dialkyl ketones include, but are not limited to, distearyl ketone.

Specific examples of the polyolefin waxes include, but are not limited to, polyethylene wax and polypropylene wax.

Specific examples of the long-chain hydrocarbons include, but are not limited to, paraffin wax and SAZOL wax.

In some embodiments, the release agent has a melting point of 40 to 160° C., 50 to 120° C., or 60 to 90° C. When the melting point is less than 40° C., heat-resistant storage stability of the toner may be poor. When the melting point is greater than 160° C., cold offset resistance of the toner may be poor.

In some embodiments, the release agent has a melt-viscosity of 5 to 1,000 cps or 10 to 100 cps, at a temperature 20° C. higher than the melting point. When the melt-viscosity is less than 5 cps, releasability of the toner may be poor. When the melt-viscosity is greater than 1,000 cps, hot offset resistance and low-temperature fixability of the toner may be poor.

In some embodiments, the content of the release agent in the mother particle is 1 to 40% by weight or 3 to 30% by weight. When the content of the release agent is greater than 40% by weight, fluidity of the toner may be poor.

The toner may include a negative or positive charge controlling agent.

Specific examples of usable negative charge controlling agents include, but are not limited to, resins and compounds having an electron-donating functional group, azo dyes, and metal complexes of organic acids. Specific examples of commercially available negative charge controlling agents include, but are not limited to, BONTRON® S-31, S-32, S-34, S-36, S-37, S-39, S-40, S-44, E-81, E-82, E-84, E-86, E-88, A, 1-A, 2-A, and 3-A (from Orient Chemical Industries Co., Ltd.); KAYACHARGE N-1 and N-2 and KAYASET BLACK T-2 and 004 (from Nippon Kayaku Co., Ltd.); AIZEN SPILON BLACK T-37, T-77, T-95, TRH, and TNS-2 (from Hodogaya Chemical Co., Ltd.); and FCA-1001-N, FCA-1001-NB, and FCA-1001-NZ (from Fujikura Kasei Co., Ltd.). Two or more of these materials can be used in combination.

Specific examples of usable positive charge controlling agents include, but are not limited to, basic compounds such as nigrosine dyes, cationic compounds such as quaternary ammonium salts, and metal salts of higher fatty acids. Specific examples of commercially available positive charge controlling agents include, but are not limited to, BONTRON® N-01, N-02, N-03, N-04, N-05, N-07, N-09, N-10, N-11, N-13, P-51, P-52, and AFP-B (from Orient Chemical Industries Co., Ltd.); TP-302, TP-415, and TP-4040 (from Hodogaya Chemical Co., Ltd.); COPY BLUE® PR and COPY CHARGE® PX-VP-435 and NX-VP-434 (from Hoechst AG); FCA 201, 201-B-1, 201-B-2, 201-B-3, 201-PB, 201-PZ, and 301 (from Fujikura Kasei Co., Ltd.); and PLZ 1001, 2001, 6001, and 7001 (from Shikoku Chemicals Corporation). Two or more of these materials can be used in combination.

In some embodiments, the content of the charge controlling agent is 0.1 to 10% by weight or 0.2 to 5% by weight, based on 100% by weight of the binder resin. When the content of the charge controlling agent is greater than 10% by weight, the toner may be too excessively charged to be electrostatically attracted to a developing roller, resulting in deterioration of fluidity and image density. When the content of the charge controlling agent is less than 1% by weight, the toner may not be quickly or sufficiently charged, resulting in poor image quality.

The mother particle may be produced by any method, such as a pulverization method, an emulsion polymerization method, a suspension polymerization method, and a polymer suspension method.

A typical pulverization method is described in detail below. First, a mixture of raw materials is melt-kneaded by a melt-kneader. Usable melt-kneaders include single-axis or double-axis continuous kneaders and roll mill batch kneaders. Specific examples of commercially-available melt-kneaders include, but are not limited to, TWIN SCREW EXTRUDER KTK (from Kobe Steel, Ltd.), TWIN SCREW COMPOUNDER TEM (from Toshiba Machine Co., Ltd.), MIRACLE K.C.K (from Asada Iron Works Co., Ltd.), TWIN SCREW EXTRUDER PCM (from Ikegai Co., Ltd.), and KOKNEADER (from Buss Corporation). The melt-kneading conditions are adjusted so as not to cut molecular chains of the binder resin. For example, when the melt-kneading temperature is too much higher than the softening point of the binder resin, molecular chains may be significantly cut. When the melt-kneading temperature is too much lower than the softening point of the binder resin, the raw materials may not be sufficiently kneaded.

Next, the resulting kneaded product is pulverized. The kneaded product may be first pulverized into coarse particles and subsequently pulverized into fine particles. Specific pulverization methods include, for example, a method in which the kneaded product is brought into collision with a collision plate in a jet stream, a method in which particles are brought into collision with each other in a jet stream, and a method in which the kneaded product is pulverized within a narrow gap between mechanically rotating rotor and stator.

The resulting particles are classified by size, and particles within a predetermined size range are collected. Undesired fine particles are removed by cyclone separation, decantation, or centrifugal separation, for example. Undesired coarse or aggregated particles are removed by a sieve having a mesh size of 250 or more.

The mother toner may be prepared by dissolving or dispersing toner components including a polyester resin reactive with an active hydrogen group (hereinafter "prepolymer (A)") in an organic solvent to prepare a toner components liquid, dispersing the toner components liquid in an aqueous medium containing a resin particle, and reacting the prepolymer (A) with a compound having an active hydrogen group in the aqueous medium. The toner components may include a colorant.

The prepolymer (A) is a reaction product of a polyester resin having an active hydrogen group with a polyisocyanate (3). The polyester resin is a polycondensation product of a polyol (1) with a polycarboxylic acid (2). The active hydrogen group may be, for example, a hydroxyl group (e.g., an alcoholic hydroxyl group, a phenolic hydroxyl group), an amino group, a carboxyl group, or a mercapto group.

Specific examples of the polyol (1) include, but are not limited to, alkylene glycols (e.g., ethylene glycol, 1,2-propylene glycol, 1,3-propylene glycol, 1,4-butanediol, 1,6-hexanediol); alkylene ether glycols (e.g., diethylene glycol, triethylene glycol, dipropylene glycol, polyethylene glycol, polypropylene glycol, polytetramethylene ether glycol); alicyclic diols (e.g., 1,4-cyclohexanedimethanol, hydrogenated bisphenol A); bisphenols (e.g., bisphenol A, bisphenol F, bisphenol S); 4,4'-dihydroxy biphenyls (e.g., 3,3'-difluoro-4,4'-dihydroxy biphenyl); bis(hydroxyphenyl)alkanes (e.g., bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (also known as tetrafluorobisphenol A), 2,2-bis(3-hydroxyphenyl)-1,1,1,3,3,3-hexafluoropropane); bis(4-hydroxyphenyl)ethers (e.g., bis(3-fluoro-4-hydroxyphenyl)ether); alkylene oxide (e.g., ethylene oxide, propylene oxide, butylene oxide) adducts of the alicyclic diols; and alkylene oxide (e.g., ethylene oxide, propylene oxide, butylene oxide) adducts of the bisphenols. In some embodiments, an alkylene glycol having 2 to 12 carbon atoms or an alkylene oxide adducts of a bisphenol is used. In some embodiments, a mixture of an alkylene oxide adduct of a bisphenol and an alkylene glycol having 2 to 12 carbon atoms is used.

Specific examples of the polyol (1) further include, but are not limited to, polyols having 3 or more valences, such as polyvalent aliphatic alcohols having 3 or more valences (e.g., glycerin, trimethylolethane, trimethylolpropane, pentaerythritol, sorbitol), polyphenols having 3 or more valences (e.g., trisphenol PA, phenol novolac, cresol novolac), and alkylene oxide adducts of the polyphenols having 3 or more valences.

Two or more of these polyols can be used in combination.

Specific examples of the polycarboxylic acid (2) include, but are not limited to, alkylene dicarboxylic acids (e.g., succinic acid, adipic acid, sebacic acid); alkenylene dicarboxylic acids (e.g., maleic acid, fumaric acid); and aromatic dicarboxylic acids (e.g., phthalic acid, isophthalic acid, terephthalic acid, naphthalenedicarboxylic acid, 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethyl isophthalic acid, 2,2-bis(4-carboxyphenyl) hexafluoropropane, 2,2-bis(3-carboxyphenyl) hexafluoropropane, 2,2'-bis(trifluoromethyl)-4,4'-biphenyl dicarboxylic acid, 3,3'-bis(trifluoromethyl)-4,4'-biphenyl dicarboxylic acid, 2,2'-bis(trifluoromethyl)-3,3'-biphenyl dicarboxylic acid, hexafluoroisopropylidene diphthalic anhydride). In some embodiments, an alkenylene dicarboxylic acid having 4 to 20 carbon atoms or an aromatic dicarboxylic acid having 8 to 20 carbon atoms is used.

Specific examples of the polycarboxylic acid (2) further include, but are not limited to, polycarboxylic acids having 3 or more valences, such as aromatic polycarboxylic acids having 9 to 20 carbon atoms (e.g., trimellitic acid, pyromellitic acid); and anhydrides, lower alkyl esters (e.g., methyl ester, ethyl ester, isopropyl ester) of the above aromatic polycarboxylic acids.

Two or more of these polycarboxylic acids can be used in combination.

In some embodiments, the equivalent ratio [OH]/[COOH] of hydroxyl groups [OH] in the polyol (1) to carboxyl groups [COOH] in the polycarboxylic acid (2) is 2/1 to 1/1, 1.5/1 to 1/1, or 1.3/1 to 1.02/1.

In some embodiments, the polyester resin obtained from the polyol (1) and the polycarboxylic acid (2) has a peak molecular weight of 1,000 to 30,000, 1,500 to 10,000, or 2,000 to 8,000. When the peak molecular weight is less than 1,000, heat-resistant storage stability of the toner may be poor. When the peak molecular weight is greater than 10,000, low-temperature fixability of the toner may be poor.

Specific examples of the polyisocyanate (3) include, but are not limited to, aliphatic polyisocyanates (e.g., tetramethylene diisocyanate, hexamethylene diisocyanate, 2,6-diisocyanatomethyl caproate), alicyclic polyisocyanates (e.g., isophorone diisocyanate, cyclohexylmethane diisocyanate), aromatic diisocyanates (e.g., tolylene diisocyanate, diphenylmethane diisocyanate), aromatic aliphatic diisocyanates (e.g., $\alpha,\alpha,\alpha',\alpha'$-tetramethylxylylene diisocyanate), isocyanurates, and the above polyisocyanates in which the isocyanate group is blocked with a phenol derivative, an oxime, or a caprolactam. Two or more of these materials can be used in combination.

In some embodiments, the equivalent ratio [NCO]/[OH] of isocyanate groups [NCO] in the polyisocyanate (3) to hydroxyl groups [OH] in the polyester resin having an active hydrogen group is 5/1 to 1/1, 4/1 to 1.2/1, or 2.5/1 to 1.5/1. When the equivalent ratio [NCO]/[OH] is greater than 5, low-temperature fixability of the toner may be poor. When the equivalent ratio [NCO]/[OH] is less than 1, hot offset resistance of the toner may be poor because the content of urethane and urea groups in the resulting modified polyester is too small.

In some embodiments, the prepolymer (A) includes units from the polyisocyanate (3) in an amount of 0.5 to 40% by weight, 1 to 30% by weight, or 2 to 20% by weight. When the content of the units is less than 0.5% by weight, offset resistance of the toner may be poor. When the content of the units is greater than 40% by weight, low-temperature fixability of the toner may be poor.

In some embodiments, the number of isocyanate groups included in one molecule of the prepolymer (A) is 1 or more, 1.5 to 3, or 1.8 to 2.5. When the number of isocyanate groups is less than 1, offset resistance of the toner may be poor because the molecular weight of the resulting modified polyester is too small.

The compound having an active hydrogen group may be, for example, an amine (B). The amine (B) may be, for example, a diamine (B1), a polyamine (B2) having 3 or more valences, an amino alcohol (B3), an amino mercaptan (B4), an amino acid (B5), or a blocked amine (B6) in which the amino group in any of the amines (B1) to (B5) is blocked.

Specific examples of the diamine (B1) include, but are not limited to, aromatic diamines (e.g., phenylenediamine, diethyltoluenediamine, 4,4'-diaminodiphenylmethane, tetrafluoro-p-xylylenediamine, tetrafluoro-p-phenylenediamine); alicyclic diamines (e.g., 4,4'-diamino-3,3'-dimethyldicyclohexylmethane, diaminocyclohexane, isophoronediamine); and aliphatic diamines (e.g., ethylenediamine, tetramethylenediamine, hexamethylenediamine, dodecafluorohexylenediamine, tetracosafluorododecylenediamine).

Specific examples of the polyamine (B2) having 3 or more valences include, but are not limited to, diethylenetriamine and triethylenetetramine.

Specific examples of the amino alcohol (B3) include, but are not limited to, ethanolamine and hydroxyethylaniline.

Specific examples of the amino mercaptan (B4) include, but are not limited to, aminoethyl mercaptan and aminopropyl mercaptan.

Specific examples of the amino acid (B5) include, but are not limited to, aminopropionic acid and aminocaproic acid.

Specific examples of the blocked amine (B6) include, but are not limited to, ketimine compounds obtained from the above-described amines (B1) to (B5) and ketones (e.g., acetone, methyl ethyl ketone, methyl isobutyl ketone), and oxazoline compounds.

To control the molecular weight of the resulting modified polyester, a reaction terminator that terminates elongation and/or cross-linking reactions between the prepolymer (A) and the amine (B) can be used. Specific examples of usable reaction terminators include, but are not limited to, monoamines (e.g., diethylamine, dibutylamine, butylamine, laurylamine) and blocked monoamines (e.g., ketimine compounds).

In some embodiments, the equivalent ratio [NCO]/[NHx] of isocyanate groups [NCO] in the prepolymer (A) to amino groups [NHx] in the amine (B) is 1/2 to 2/1, 1.5/1 to 1/1.5, or 1.2/1 to 1/1.2. When the equivalent ratio [NCO]/[NHx] is greater than 2 or less than ½, hot offset resistance of the toner may be poor because the molecular weight of the resulting modified polyester is too small.

The organic solvent in which the toner components are dissolved or dispersed may be a volatile solvent having a boiling point less than 100° C. Such a solvent is easily removable in succeeding processes. Specific examples of such organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Two or more of these solvents can be used in combination. In some embodiments, an ester solvent (e.g., methyl acetate, ethyl acetate), an aromatic solvent (e.g., toluene, xylene), or a halogenated hydrocarbon (e.g., methylene chloride, 1,2-dichloroethane, chloroform, carbon tetrachloride) is used. Each of the toner components may be dissolved or dispersed in the organic solvent either simultaneously or independently. In the latter case, each of the toner components may be dissolved or dispersed in an independent organic solvent. In some embodiments, in view of ease of solvent removal treatment, all of the toner components are dissolved or dispersed in a single organic solvent.

In some embodiments, the resin content in the toner components liquid is 40 to 80% by weight. When the resin content is greater than 80% by weight, it may be difficult to dissolve or disperse the toner components and the viscosity of the toner components liquid is too high to handle. When the resin content is less than 40% by weight, the toner production may be too small. When a polyester resin and a prepolymer are used in combination, each of them may be dissolved or dispersed in either a single organic solvent or an independent organic solvent. Because of having different solubility and viscosity, each of the polyester resin and the prepolymer may be dissolved or dispersed in an independent organic solvent.

The colorant may be dissolved or dispersed in an organic solvent independently. Alternatively, the colorant may be dissolved or dispersed in the solution or dispersion of the polyester resin prepared above. An auxiliary dispersant or a polyester resin may be further added to the colorant solution or dispersion. The colorant may be also used in the form of master batch.

When the release agent is a wax insoluble in the organic solvent, the wax is dispersed in the organic solvent by a typical known method. For example, the organic solvent and the wax are mixed and subjected to a dispersion treatment by a disperser such as a bead mill. To make the dispersing time shorter, the mixture may be heated to the melting point of the wax and subsequently cooled while being agitated before subjected to the dispersion treatment. Two or more of waxes can be used in combination. An auxiliary dispersant or a polyester resin may be further added to the wax solution or dispersion.

The aqueous medium may be, for example, water alone or a mixture of water with a water-miscible solvent. Specific examples of usable water miscible solvents include, but are not limited to, alcohols (e.g., methanol, isopropanol, ethylene glycol), dimethylformamide, tetrahydrofuran, cellosolves (e.g., methyl cellosolve), and lower ketones (e.g., acetone, methyl ethyl ketone). In some embodiments, the amount of the aqueous medium is 50 to 2,000 parts by weight or 100 to 1,000 parts by weight, based on 100 parts by weight of the toner components. When the amount of the aqueous medium is less than 50 parts by weight, the toner components may not be finely dispersed. When the amount of the aqueous medium is greater than 2,000 parts by weight, manufacturing cost may increase.

The aqueous medium, in which the toner components liquid is to be dispersed, may contain an inorganic dispersant or a resin particle, so that the resulting particles are reliably dispersed in the aqueous medium while having a narrow size distribution.

Specific examples of usable inorganic dispersants include, but are not limited to, tricalcium phosphate, calcium carbonate, titanium oxide, colloidal silica, and hydroxyapatite.

The resin particle may be comprised of a resin capable of forming an aqueous dispersion thereof. Specific examples of such resins include, but are not limited to, thermoplastic and thermosetting resins such as vinyl resin, polyurethane resin, epoxy resin, polyester resin, polyamide resin, polyimide resin, silicone resin, phenol resin, melamine resin, urea resin, aniline resin, ionomer resin, and polycarbonate resin. Two or more of these resins can be used in combination. In some embodiments, a vinyl resin, a polyurethane resin, an epoxy resin, a polyester resin, or a combination thereof is used because they are easy to form an aqueous dispersion of fine spherical particles thereof.

An aqueous dispersion of the resin particle may be produced by the following procedures (a) to (h), for example.

(a) An aqueous dispersion of a vinyl resin is obtainable by directly subjecting raw materials of the resin including a monomer to a suspension polymerization, a seed polymerization, or a dispersion polymerization.

(b) An aqueous dispersion of a polyaddition or polycondensation resin (e.g., polyester resin, polyurethane resin, epoxy resin) is obtainable by dispersing a precursor (e.g., monomer, oligomer) of the resin or a solution thereof in an aqueous medium in the presence of a dispersant, and curing the precursor by application of heat or addition of a curing agent.

(c) An aqueous dispersion of a polyaddition or polycondensation resin (e.g., polyester resin, polyurethane resin, epoxy resin) is obtainable by dissolving an emulsifier in a precursor (e.g., monomer, oligomer) of the resin or a solution (preferably in a liquid state, or which may be liquefied by application of heat) thereof, and further adding water thereto to cause phase-transfer emulsification.

(d) An aqueous dispersion of a resin produced by a polymerization reaction (e.g., addition polymerization, ring-opening polymerization, polyaddition, addition condensation, polycondensation) is obtainable by pulverizing the resin into particles by a mechanical rotary pulverizer or a jet pulverizer, classifying the particles by size to collect desired-size particles, and dispersing the collected particles in an aqueous medium in the presence of a dispersant.

(e) An aqueous dispersion of a resin produced by a polymerization reaction (e.g., addition polymerization, ring-opening polymerization, polyaddition, addition condensation, polycondensation) is obtainable by dissolving the resin in a solvent, spraying the resulting resin solution to form resin particles, and dispersing the resin particles in an aqueous medium in the presence of a dispersant.

(f) An aqueous dispersion of a resin produced by a polymerization reaction (e.g., addition polymerization, ring-opening polymerization, polyaddition, addition condensation, polycondensation) is obtainable by dissolving the resin in a solvent and further adding a solvent to the resulting resin solution, or dissolving the resin in a solvent by application of heat and cooling the resulting resin solution, to precipitate resin particles, removing the solvent to isolate the resin particles, and dispersing the resin particles in an aqueous medium in the presence of a dispersant.

(g) An aqueous dispersion of a resin produced by a polymerization reaction (e.g., addition polymerization, ring-opening polymerization, polyaddition, addition condensation, polycondensation) is obtainable by dissolving the resin in a solvent, dispersing the resulting resin solution in an aqueous medium in the presence of a dispersant, and removing the solvent by application of heat and/or reduction of pressure.

(h) An aqueous dispersion of a resin produced by a polymerization reaction (e.g., addition polymerization, ring-opening polymerization, polyaddition, addition condensation, polycondensation) is obtainable by dissolving the resin in a solvent, dissolving an emulsifier in the resulting resin solution, and adding water thereto to cause phase-transfer emulsification.

The aqueous medium may further contain a surfactant to reliably disperse the toner components liquid. Specific examples of usable surfactants include, but are not limited to, anionic surfactants such as alkylbenzene sulfonates, α-olefin sulfonates and phosphates; cationic surfactants such as amine salt type surfactants (e.g., alkylamine salts, amino alcohol fatty acid derivatives, polyamine fatty acid derivatives, imidazoline) and quaternary ammonium salt type surfactants (e.g., alkyl trimethyl ammonium salts, dialkyl dimethyl ammonium salts, alkyl dimethyl benzyl ammonium salts, pyridinium salts, alkyl isoquinolinium salts, and benzethonium chloride); nonionic surfactants such as fatty acid amide derivatives and polyvalent alcohol derivatives; and ampholytic surfactants such as alanine, dodecylbis(aminoethyl)glycine, bis(octylaminoethyl)glycine, and N-alkyl-N,N-dimethyl ammonium betaine.

Surfactants having a fluoroalkyl group can achieve an effect in a small amount. Specific examples of usable anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11)oxy]-1-alkyl(C3-C4) sulfonic acid sodium, 3-[ω-fluoroalkanoyl(C6-C8)-N-ethylamino]-1-propane sulfonic acid sodium, fluoroalkyl(C11-C20) carboxylic acids and metal salts thereof, perfluoroalkyl(C7-C13) carboxylic acids and metal salts thereof, perfluoroalkyl(C4-C12) sulfonic acids and metal salts thereof, perfluorooctane sulfonic acid diethanol amide, N-propyl-N-(2-hydroxyethyl) perfluorooctane sulfonamide, perfluoroalkyl(C6-C10) sulfonamide propyl trimethyl ammonium salts, perfluoroalkyl(C6-C10)-N-ethyl sulfonyl glycine salts, and monoperfluoroalkyl(C6-C16) ethyl phosphates. Specific examples of usable cationic surfactants having a fluoroalkyl group include, but are not limited to, aliphatic primary, secondary, and tertiary amine acids having a fluoroalkyl group, aliphatic quaternary ammonium salts such as perfluoroalkyl(C6-C10) sulfonamide propyl trimethyl ammonium salts, benzalkonium salts, benzethonium chlorides, pyridinium salts, and imidazolinium salts.

The aqueous medium may further contain a polymeric protection colloid to stabilize dispersing liquid droplets. Specific examples of usable polymeric protection colloids include, but are not limited to, homopolymers and copolymers obtained from monomers, such as acids (e.g., acrylic acid, methacrylic acid, α-cyanoacrylic acid, α-cyanomethacrylic acid, itaconic acid, crotonic acid, fumaric acid, maleic acid, maleic anhydride), hydroxyl-group-containing acrylates and methacrylates (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate), vinyl alcohols and vinyl alcohol ethers (e.g., vinyl methyl ether, vinyl ethyl ether, vinyl propyl ether), esters of vinyl alcohols with carboxyl-group-containing compounds (e.g., vinyl acetate, vinyl propionate, vinyl butyrate), amides (e.g., acrylamide, methacrylamide, diacetone acrylamide) and methylol compounds thereof (e.g., N-methylol acrylamide, N-methylol methacrylamide), acid chlorides (e.g., acrylic acid chloride, methacrylic acid chloride), and monomers containing nitrogen or a nitrogen-containing heterocyclic ring (e.g., vinyl pyridine, vinyl pyrrolidone, vinyl imidazole, ethylene imine); polyoxyethylenes (e.g., polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester, polyoxyethylene nonyl phenyl ester); and celluloses (e.g., methyl cellulose, hydroxyethyl cellulose, hydroxypropyl cellulose).

In a case in which a dispersant soluble in acids and bases (e.g., calcium phosphate) is used, the resulting mother particles may be first washed with an acid (e.g., hydrochloric acid) and then washed with water to remove the dispersant. Alternatively, such a dispersant can be removed with an enzyme. In some embodiments, dispersants keep remaining on the surface of the mother particle. In some embodiments, dispersants are removed from the surface of the mother particle in terms of chargeability.

The toner components liquid is dispersed in the aqueous medium using a low-speed shearing disperser, a high-speed shearing disperser, a frictional disperser, a high-pressure jet disperser, or an ultrasonic disperser, for example. In some embodiments, a high-speed shearing disperser is used to make the dispersing liquid droplets have an average particle diameter of 2 to 20 μm. In such embodiment, the high-speed shearing disperser operates at a revolution of 1,000 to 30,000 rpm or 5,000 to 20,000 rpm. The dispersing time may be 0.1 to 5 minutes for a batch type. The dispersing temperature may be 0 to 150° C. or 20 to 80° C.

The solvent can be removed from the resulting emulsion by gradually heating the emulsion under normal or reduced pressures to completely evaporate the solvent from liquid droplets. Alternatively, the solvent can be removed from the emulsion by spraying the emulsion into dry atmosphere to completely evaporate the solvent from liquid droplets. In this case, the surfactant can also be evaporated. The dry atmosphere into which the emulsion is sprayed may be, for example, air, nitrogen gas, carbon dioxide gas, or combustion gas, which is heated to above the boiling point of the solvent.

Such a treatment can be reliably performed by a spray drier, a belt drier, or a rotary kiln, within a short period of time.

The amine (B) may be previously mixed with the toner components liquid before the toner components liquid is added to the aqueous medium. Alternatively, the amine (B) may be added to the aqueous medium after the toner components liquid is dispersed therein. The reaction time between the prepolymer (A) and the amine (B) may be 1 minute to 40 hours or 1 to 24 hours. The reaction temperature may be 0 to 150° C. or 20 to 98° C. A catalyst can be used, if needed.

The mother particle dispersed in the aqueous medium may be washed and dried out by any known procedure. For example, one procedure includes subjecting the emulsion to solid-liquid separation by centrifugal separation or filter press to obtain a toner cake, redispersing the toner cake in ion-exchange water having a normal temperature to a temperature around 40° C., optionally controlling the pH by addition of an acid or an alkaline, and subjecting the dispersion to solid-liquid separation again. This procedure is repeated for several times. Thus, impurities and surfactants are removed in the above procedure. The mother particle is then dried out by a flash drier, a circulating drier, a reduced-pressure drier, or a vibrating fluidizing drier. Undesired fine particles may be removed in the process of centrifugal separation. The dried mother particle may be subjected to classification by a classifier to collect particles having a desired particle diameter distribution.

The mother particle is mixed with the external additive by a typical powder mixer. Preferably, the mixer is equipped with a jacket so that the inner temperature is variable. To vary load history given to the external additive, the external additive may be gradually added or added from the middle of the mixing, while optionally varying the revolution, rotating speed, time, and temperature in the mixing. The load may be initially strong and gradually weaken, or vice versa. Specific examples of usable mixers include, but are not limited to, a V-type mixer, a Rocking mixer, a Loedige mixer, a Nauta mixer, and a Henschel mixer.

A developer according to an embodiment may be either a one-component developer consisting of the toner according to an embodiment, or a two-component developer consisting of the toner according to an embodiment and a carrier. The two-component developer may be used for high-speed printers in accordance with recent improvement in information processing speed because of having a long lifespan.

In some embodiments, the two-component developer includes the toner in an amount of 1 to 10 parts by weight based on 100 parts by weight of the carrier.

In the one-component developer according to an embodiment, the average toner size may not vary very much although consumption and supply of toner particles are repeated. Additionally, toner particles may not adhere or fix to a developing roller or a toner layer regulating blade. Thus, the one-component developer reliably provides stable developability and image quality for an extended period of time. In the two-component developer according to an embodiment, the average toner size may not vary very much although consumption and supply of toner particles are repeated. Thus, the two-component developer reliably provides stable developability for an extended period of time.

The carrier may comprise a core material and a resin layer that covers the core material.

Specific examples of usable core materials include, but are not limited to, manganese-strontium (Mn—Sr) and manganese-magnesium (Mn—Mg) materials having a magnetization of 50 to 90 emu/g. High magnetization materials such as iron powders having a magnetization of 100 emu/g or more and magnetites having a magnetization of 75 to 120 emu/g are suitable for improving image density. Additionally, low magnetization materials such as copper-zinc (Cu—Zn) materials having a magnetization of 30 to 80 emu/g are suitable for producing a high-quality image, because carriers made of such materials can weakly contact a photoreceptor. Two or more of these materials can be used in combination.

In some embodiments, the core material has a weight average particle diameter of 10 to 200 μm or 40 to 100 μm. When the weight average particle diameter is less than 10 μm, it means that the resulting carrier particles include a relatively large amount of fine particles, and therefore the magnetization per carrier particle is too low to prevent carrier particles scattering. When the weight average particle diameter is greater than 200 μm, it means that the specific surface area of the carrier particle is too small to prevent toner particles from scattering. Therefore, solid portions in full-color images may not be reliably reproduced.

Specific examples of usable resins for the resin layer include, but are not limited to, amino resins, polyvinyl resins, polystyrene resins, halogenated olefin resins, polyester resins, polycarbonate resins, polyethylene resins, polyvinyl fluoride resins, polyvinylidene fluoride resins, poly(trifluoroethylene) resins, poly(hexafluoropropylene) resins, vinylidene fluoride-acrylic monomer copolymer, vinylidene fluoride-vinyl fluoride copolymer, tetrafluoroethylene-vinylidene fluoride-non-fluoride monomer terpolymer, and silicone resins. Two or more of these resins can be used in combination.

Specific examples of the amino resins include, but are not limited to, urea-formaldehyde resin, melamine resin, benzoguanamine resin, urea resin, polyamide resin, and epoxy resin. Specific examples of the polyvinyl resins include, but are not limited to, acrylic resin, polymethyl methacrylate, polyacrylonitrile, polyvinyl chloride, polyvinyl alcohol, and polyvinyl butyral. Specific examples of the polystyrene resins include, but are not limited to, polystyrene and styrene-acrylic copolymer. Specific examples of the halogenated olefin resins include, but are not limited to, polyvinyl chloride. Specific examples of the polyester resins include, but are not limited to, polyethylene terephthalate and polybutylene terephthalate.

The resin layer may contain a conductive powder. Specific examples of usable conductive powders include, but are not limited to, metal, carbon black, titanium oxide, tin oxide, and zinc oxide. In some embodiments, the conductive powder has an average particle diameter of 1 μm or less. When the average particle diameter is greater than 1 μm, it may be difficult to control electric resistivity of the resin layer.

The resin layer can be formed by, for example, dissolving a resin (e.g., a silicone resin) in a solvent to prepare a coating liquid, and uniformly applying the coating liquid on the surface of the core material, followed by drying and baking. The coating method may be, for example, dip coating, spray coating, or brush coating.

Specific examples of usable solvents include, but are not limited to, toluene, xylene, methyl ethyl ketone, methyl isobutyl ketone, methyl cellosolve, and butyl acetate.

The baking method may be either an external heating method or an internal heating method that uses a stationary electric furnace, a fluid electric furnace, a rotary electric furnace, a burner furnace, or microwave.

In some embodiments, the content of the resin layer in the carrier is 0.01 to 5.0% by weight. When the content of the resin layer is less than 0.01% by weight, it means that the resin layer cannot be uniformly formed on the core material. When the content of the resin layer is greater than 5.0% by weight, it means that the resin layer is so thick that each carrier particles may be fused with each other.

The developer may be used for any electrophotographic methods, such as magnetic one-component developing methods, non-magnetic one-component developing methods, and two-component developing methods.

A process cartridge according to an embodiment integrally supports at least a photoreceptor on which an electrostatic latent image is formed and a developing device that develops the electrostatic latent image into a toner image with the developer according to an embodiment. The process cartridge is detachably attachable to an image forming apparatus.

FIGURE illustrates a process cartridge according to an embodiment. The process cartridge includes a photoreceptor 10, a charger 20, an irradiator 30, a developing device 40, a cleaning device 60, and a transfer device 80.

An image forming method according to an embodiment includes at least an electrostatic latent image forming process, a developing process, and a transfer process, and optionally includes other processes such as a fixing process, a neutralization process, a cleaning process, a recycle process, and a control process, if needed.

An image forming apparatus according to an embodiment includes at least a photoreceptor, a charger, an irradiator, a developing device, and a transfer device, and optionally includes other members such as a fixing device, a neutralizer, a cleaner, a recycler, and a controller, if needed.

The electrostatic latent image forming process is a process which forms an electrostatic latent image on a photoreceptor. In the electrostatic latent image forming process, for example, a charger uniformly charges a surface of the photoreceptor by supplying a voltage to the surface and an irradiator irradiates the charged surface with light containing image information.

There is not a limit on material, shape, structure, or size of the photoreceptor. Preferably, the photoreceptor has a drum-like shape. The photoreceptor may be comprised of an inorganic photoconductor, such as amorphous silicone and selenium, or an organic photoconductor, such as polysilane and phthalopolymethyne. In some embodiments, amorphous silicone is used because of having a long lifespan.

The charger may be, for example, a contact charger equipped with a conductive or semiconductive roll, brush, film, or rubber blade, or a non-contact charger such as corotron and scorotron that use corona discharge. The charger is disposed either contacting or non-contacting the photoreceptor. In some embodiments, the charger charges a surface of the photoreceptor by being supplied with a direct current voltage overlapped with an alternating current voltage.

In some embodiments, the charger is a non-contact charging roller disposed proximal to the photoreceptor which charges a surface of the photoreceptor by being supplied with a direct current voltage overlapped with an alternating current voltage.

The irradiator may be, for example, a radiation optical type, a rod lens array type, a laser optical type, or a liquid crystal shutter optical type. The photoreceptor may be irradiated with light from the reverse surface (back surface) side thereof.

The developing process is a process which develops the electrostatic latent image into a toner image that is visible with the developer according to an embodiment.

In some embodiments, the developing device includes a container that contains the developer according to an embodiment and a developer bearing member that supplies the developer to the electrostatic latent image with or without contacting the electrostatic latent image. The developing device may employ either a dry developing method or a wet developing method. The developing device may be either a single-color developing device or a multi-color developing device. The developing device may be comprised of an agitator that frictionally agitates and charges the developer, and a rotatable magnet roller. In the developing device, toner particles and carrier particles are mixed and agitated so that the toner particles are frictionally charged. The charged toner particles and carrier particles are borne on the surface of the magnet roller forming chainlike aggregations (hereinafter "magnetic brush"). The magnet roller is disposed adjacent to the photoreceptor. Therefore, a part of the toner particles in the magnetic brush migrates from the surface of the magnet roller to the surface of the photoreceptor due to electrical attractive force. As a result, the electrostatic latent image formed on the photoreceptor is developed into a toner image. When toner particles migrate to the surface of the photoreceptor, an alternation electric field may be applied.

The transfer process is a process which transfers the toner image from the photoreceptor onto a recording medium. In some embodiments, the toner image is primarily transferred from the photoreceptor onto an intermediate transfer medium, and secondarily transferred from the intermediate transfer medium onto the recording medium. In such embodiments, multiple toner images with different colors are primarily transferred from the respective photoreceptors onto the intermediate transfer medium to form a composite toner image, and the composite toner image is secondarily transferred from the intermediate transfer medium onto the recording medium. The toner image may be transferred from the photoreceptor upon charging the photoreceptor by a transfer charger.

In some embodiments, the transfer device includes a primary transfer device that transfers toner images from the respective photoreceptors onto the intermediate transfer medium to form a composite toner image, and a secondary transfer device that transfers the composite toner image from the intermediate transfer medium onto a recording medium. In such embodiments, the transfer device (including the primary transfer device and the secondary transfer device) contains a transfer unit that separates a toner image from the photoreceptor toward a recording medium side. The number of the transfer device may be one or more. The transfer unit may be, for example, a corona discharger, a transfer belt, a transfer roller, a pressure transfer roller, or an adhesive transfer unit.

The intermediate transfer medium may be, for example, a transfer belt.

The recording medium is not limited to a specific material, and any kind of material can be used as the recording medium.

The fixing process is a process in which the fixing device fixes the toner image on a recording medium. Each single-color toner image may be independently fixed on a recording medium. Alternatively, a composite toner image including multiple color toner images may be fixed on a recording medium at once.

In some embodiments, the fixing device includes fixing members that fix a toner image by application of heat and pressure. The fixing members may have a roller-like or belt-like shape. For example, the fixing device may include a combination of a heating roller and a pressing roller, or a combination of a heating roller, a pressing roller, and an endless belt. The heating temperature may be 80 to 200° C.

In some embodiments, the fixing device includes a heater equipped with a heating element, a film in contact with the heater, and a pressing member that presses against the heater with the film therebetween. A recording medium having a toner image thereon is passed through between the film and the pressing member so that the toner image is fixed on the recording medium by application of heat and pressure.

In the fixing process, an optical fixer can be used in place of or in combination with the fixing device.

The neutralization process is a process in which the neutralizer neutralizes the photoreceptor by applying a neutralization bias thereto. The neutralizer may be, for example, a neutralization lamp.

The cleaning process is a process in which the cleaner removes residual toner particles remaining on the photoreceptor. The cleaner may be, for example, a magnetic brush cleaner, an electrostatic brush cleaner, a magnetic roller cleaner, a blade cleaner, a brush cleaner, or a web cleaner.

The recycle process is a process in which the recycler supplies the residual toner particles collected in the cleaning process to the developing device. The recycler may be, for example, a conveyer.

The control process is a process in which the controller controls the above-described processes. The controller may be, for example, a sequencer or a computer.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Preparation of Mother Particle A

Preparation of Resin Particle Dispersion

A reaction vessel equipped with a stirrer and a thermometer is charged with 683 parts of water, 11 parts of a sodium salt of a sulfate of ethylene oxide adduct of methacrylic acid (ELEMINOL RS-30 from Sanyo Chemical Industries, Ltd.), 83 parts of styrene, 83 parts of methacrylic acid, 110 parts of butyl acrylate, and 1 part of ammonium persulfate. The mixture is agitated for 15 minutes at a revolution of 400 rpm, thus preparing a white emulsion. The white emulsion is heated to 75° C. and subjected to reaction for 5 hours. A 1% aqueous solution of ammonium persulfate in an amount of 30 parts is further added to the emulsion, and the mixture is aged for 5 hours at 75° C. Thus, a resin particle dispersion 1 that is an aqueous dispersion of a vinyl resin (i.e., a copolymer of styrene, methacrylic acid, butyl acrylate, and a sodium salt of a sulfate of ethylene oxide adduct of methacrylic acid) is prepared. The resin particle dispersion 1 has a weight average particle diameter of 105 nm when measured by a laser diffraction particle size distribution analyzer LA-920 (from Horiba, Ltd.). The dried resin particles separated from the resin particle dispersion 1 have a glass transition temperature (Tg) of 59° C. and a weight average molecular weight of 150,000.

Preparation of Aqueous Phase

An aqueous phase 1 is prepared by mixing 990 parts of water, 83 parts of the resin particle dispersion 1, 37 parts of a 48.5% aqueous solution of dodecyl diphenyl ether sodium disulfonate (ELEMINOL MON-7 from Sanyo Chemical Industries, Ltd.), and 90 parts of ethyl acetate. The aqueous phase 1 is a milky whitish liquid.

Preparation of Low-Molecular-Weight Polyester

A reaction vessel equipped with a condenser, a stirrer, and a nitrogen inlet pipe is charged with 229 parts of ethylene oxide 2 mol adduct of bisphenol A, 529 parts of propylene oxide 3 mol adduct of bisphenol A, 208 parts of terephthalic acid, 46 parts of adipic acid, and 2 parts of dibutyltin oxide. The mixture is subjected to reaction for 8 hours at 230° C. under normal pressure, and subsequent 5 hours at reduced pressures of 10 to 15 mmHg. After adding 44 parts of trimellitic anhydride, the mixture is further subjected to reaction for 2 hours at 180° C. under normal pressure. Thus, a low-molecular-weight polyester 1 is prepared. The low-molecular-weight polyester 1 has a number average molecular weight of 2,500, a weight average molecular weight of 6,700, a glass transition temperature (Tg) of 43° C., and an acid value of 25 mgKOH/g.

Preparation of Prepolymer

A reaction vessel equipped with a condenser, a stirrer, and a nitrogen inlet pipe is charged with 682 parts of ethylene oxide 2 mol adduct of bisphenol A, 81 parts of propylene oxide 2 mol adduct of bisphenol A, 283 parts of terephthalic acid, 22 parts of trimellitic anhydride, and 2 parts of dibutyltin oxide. The mixture is subjected to reaction for 8 hours at 230° C. under normal pressure and subsequent 5 hours under reduced pressures of 10 to 15 mmHg. Thus, an intermediate polyester 1 is prepared. The intermediate polyester 1 has a number average molecular weight of 2,100, a weight average molecular weight of 9,500, a glass transition temperature (Tg) of 55° C., an acid value of 0.5 mgKOH/g, and a hydroxyl value of 51 mgKOH/g.

Another reaction vessel equipped with a condenser, a stirrer, and a nitrogen inlet pipe is charged with 410 parts of the intermediate polyester 1, 89 parts of isophorone diisocyanate, and 500 parts of ethyl acetate. The mixture is subjected to reaction for 5 hours at 100° C. Thus, a prepolymer 1 is prepared. The prepolymer 1 is including 1.53% of free isocyanates.

Preparation of Ketimine

A reaction vessel equipped with a stirrer and a thermometer is charged with 170 parts of isophoronediamine and 75 parts of methyl ethyl ketone. The mixture is subjected to reaction for 5 hours at 50° C. Thus, a ketimine compound 1 is prepared. The ketimine compound 1 has an amine value of 418 mgKOH/g.

Preparation of Master Batch

First, 35 parts of water, 40 parts of a phthalocyanine pigment FG7351 (from Toyo Ink Co., Ltd.), and 60 parts of a polyester resin RS801 (from Sanyo Chemical Industries, Ltd.) are mixed using a HENSCHEL MIXER (from Mitsui Mining and Smelting Co., Ltd.). The resulting mixture is kneaded for 30 minutes at 150° C. using a double roll, the kneaded mixture is then rolled and cooled, and the rolled mixture is then pulverized into particles using a pulverizer. Thus, a master batch 1 is prepared.

Preparation of Toner Components Liquid

A reaction vessel equipped with a stirrer and a thermometer is charged with 378 parts of the low-molecular-weight polyester 1, 110 parts of a carnauba wax, 22 parts of a charge controlling agent (a salicylic acid metal complex E-84 from Orient Chemical Industries Co., Ltd.), and 947 parts of ethyl acetate. The mixture is heated to 80° C. while being agitated, kept at 80° C. for 5 hours, and cooled to 30° C. over a period of 1 hour. The mixture is further mixed with 500 parts of the master batch 1 and 500 parts of ethyl acetate for 1 hour.

Thereafter, 1,324 parts of the resulting mixture are subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Further, 1,324 parts of a 65% ethyl acetate solution of the low-molecular-weight polyester 1 are added, and the resulting mixture is subjected to the above dispersing operation for 1 time (1 pass). Thus, a colorant wax dispersion 1 is prepared. The colorant wax dispersion 1 is containing solid components in an amount of 50% by weight.

Emulsification

In a vessel, 648 parts of the colorant wax dispersion 1, 154 parts of the prepolymer 1, and 6.6 parts of the ketimine compound 1 are mixed for 1 minute at a revolution of 5,000 rpm using a TK HOMOMIXER (from Primix Corporation). After adding 1,200 parts of the aqueous phase 1 to the vessel, the resulting mixture is further mixed for 20 minutes at a revolution of 13,000 rpm using the TK HOMOMIXER. Thus, an emulsion slurry 1 is obtained.

Shape Control

SEROGEN BS-H (from Dai-ichi Kogyo Seiyaku Co., Ltd.) in an amount of 3.15 parts is gradually added to 75.6 parts of ion-exchange water being agitated at a revolution of 2,000 rpm by a TK HOMOMIXER (from Primix Corporation), followed by agitation for 30 minutes at 20° C. The resulting SEROGEN solution is mixed with 43.3 parts of a 48.5% aqueous solution of dodecyl diphenyl ether sodium disulfonate (ELEMINOL MON-7 from Sanyo Chemical Industries, Ltd.), followed by agitation for 5 minutes at 20° C. The emulsion slurry 1 in an amount of 2,000 parts is further mixed therein by a TK HOMOMIXER at a revolution of 2,000 rpm for 1 hour. Thus, a shape control slurry 1 is prepared.

Solvent Removal

The shape control slurry 1 is contained in a vessel equipped with a stirrer and a thermometer, and subjected to solvent removal for 8 hours at 30° C. and subsequent aging for 4 hours at 45° C. Thus, a dispersion slurry 1 is prepared.

Washing and Drying

The dispersion slurry 1 in an amount of 100 parts is filtered under reduced pressures, and mixed with 100 parts of ion-exchange water using a TK HOMOMIXER for 10 minutes at a revolution of 12,000 rpm, followed by filtering, thus obtaining a wet cake (1).

The wet cake (1) is mixed with 100 parts of a 10% aqueous solution of sodium hydroxide using a TK HOMOMIXER for 30 minutes at a revolution of 12,000 rpm, followed by filtering under reduced pressures, thus obtaining a wet cake (2).

The wet cake (2) is mixed with 100 parts of a 10% hydrochloric acid using a TK HOMOMIXER for 10 minutes at a revolution of 12,000 rpm, followed by filtering, thus obtaining a wet cake (3).

The wet cake (3) is mixed with 300 parts of ion-exchange water using a TK HOMOMIXER for 10 minutes at a revolution of 12,000 rpm, followed by filtering. This operation is repeated twice, thus obtaining a filtered cake 1.

The filtered cake 1 is dried by a drier for 48 hours at 45° C., and sieved with a mesh having openings of 75 μm. Thus, a mother particle A is prepared.

Preparation of Mother Particle B by Pulverization Method

A binder resin (i.e., a polyester resin primarily comprised of ethylene oxide adduct of bisphenol A and terephthalic acid, having a weight average molecular weight of $1.1\times10^4$, a number average molecular weight of $3.9\times10^3$, a viscosity (n) of 90 Pa·s at 140° C., and a glass transition temperature (Tg) of 69° C.) in an amount of 100 parts, a high-melt-viscosity resin (i.e., a terpene-modified novolac resin, having a weight average molecular weight of 2,500, a softening point (Tm) of 165° C., and a viscosity (n) of 85,000 Pa·s at 140° C.) in an amount of 20 parts, a carbon black (BPL from Cabot Corporation) in an amount of 5 parts, a charge controlling agent (BONTRON E84 from Orient Chemical Industries Co., Ltd.) in amount of 2 parts, and a low-molecular-weight polypropylene (VISCOL 660P from Sanyo Chemical industries, Ltd.) in an amount of 5 parts are poured in an air-cooled double roll mill. The mixture is melt-kneaded for 15 minutes, followed by cooling. The cooled mixture is pulverized into fine particles by a jet mill, and the fine particles are classified by size by a wind-power classifier. Thus, a mother particle B having a volume average particle diameter of 6 μm is prepared.

Preparation of Hydroxyapatite Silica Complex Porous Particle A

A coarsely-pulverized amorphous silicic acid material (having an average particle diameter of 50 μm) is finely pulverized by a scramjet mill (MN-30 from Tokuju Corporation) while adjusting the gas pressure and the feeder input to control the resulting particle diameter. The resulting particles have a desired narrow particle diameter without any adjustment or sieving.

Generally, the scramjet mill pulverizes a raw material into nano-level ultrafine particles by colliding particles using a high-pressure gas. The scramjet mill has a cylindrical shape. Multiple pulverization nozzles are disposed on equally-divided positions on an inner periphery of the cylinder. One or more of the nozzles are configured to supply raw materials. Thus, a concentric vortex of a high-pressure jet stream is formed within the scramjet mill, which makes the resulting particles have a narrow particle size distribution. Within the scramjet mill, particles are more collide with each other than collide with inner walls of the mill. Accordingly, it is unlikely that the inner walls of the mill are abraded and contaminate the resulting fine particles.

Next, the finely-pulverized amorphous silicic acid material having an average particle diameter of 18 nm is mixed with a calcium hydroxide so that the molar ratio $CaO/SiO_2$ becomes 0.4, and further mixed with water so that the solid ratio becomes 10. The mixture is subjected to hydrothermal reaction for 4 hours at 180° C. while being agitated in an autoclave.

The resulting amorphous calcium silicate slurry is heated to 70° C., and phosphoric acid is added thereto over a period of 1 hour so that the molar ratio Ca/P becomes 1.7. Thereafter, the amorphous calcium silicate slurry is further agitated for 2 hours, followed by filtration and drying. The resulting wet cake is dried by hot wind in a hybrid powder drier (from Korenaga Iron Works Co., Ltd.). Simultaneously, particle aggregations produced in drying the slurry are loosened due to the circulating structure of the hybrid powder drier. Thus, a hydroxyapatite silica complex porous particle A having an average particle diameter of 20 nm is prepared.

Preparation of Hydroxyapatite Silica Complex Porous Particle B

The procedure for preparing the hydroxyapatite silica complex porous particle A is repeated except that the finely-pulverized amorphous silicic acid material has an average particle diameter of 32 nm. Thus, a hydroxyapatite silica complex porous particle B having an average particle diameter of 35 nm is prepared.

Preparation of Hydroxyapatite Silica Complex Porous Particle C

The procedure for preparing the hydroxyapatite silica complex porous particle A is repeated except that the finely-pulverized amorphous silicic acid material has an average particle diameter of 81 nm. Thus, a hydroxyapatite silica complex porous particle C having an average particle diameter of 85 nm is prepared.

Preparation of Hydroxyapatite Silica Complex Porous Particle D

The procedure for preparing the hydroxyapatite silica complex porous particle A is repeated except that the finely-pulverized amorphous silicic acid material has an average particle diameter of 114 nm. Thus, a hydroxyapatite silica complex porous particle D having an average particle diameter of 120 nm is prepared.

Preparation of Hydroxyapatite Silica Complex Porous Particle E

The procedure for preparing the hydroxyapatite silica complex porous particle A is repeated except that the finely-pulverized amorphous silicic acid material has an average particle diameter of 151 nm. Thus, a hydroxyapatite silica complex porous particle E having an average particle diameter of 156 nm is prepared.

Preparation of Hydroxyapatite Silica Complex Porous Particle F

The procedure for preparing the hydroxyapatite silica complex porous particle A is repeated except that the finely-pulverized amorphous silicic acid material has an average particle diameter of 203 nm. Thus, a hydroxyapatite silica complex porous particle F having an average particle diameter of 210 nm is prepared.

Preparation of Hydroxyapatite Silica Complex Porous Particle G

The procedure for preparing the hydroxyapatite silica complex porous particle A is repeated except that the finely-pulverized amorphous silicic acid material has an average particle diameter of 239 nm. Thus, a hydroxyapatite silica complex porous particle G having an average particle diameter of 245 nm is prepared.

The hydroxyapatite silica complex porous particles A to G are subjected to the measurements of the number average particle diameter (by a particle size analyzer UPA from Nikkiso Co., Ltd., employing a dynamic light scattering method), and specific surface area, total pore volume, and average pore diameter (by a BET specific surface area analyzer TriStar II 3020, employing a multipoint method in which nitrogen gas is adsorbed to a sample having been heated and degassed at 250° C.). The results are shown in Table 1.

TABLE 1

| Hydroxyapatite silica complex porous particles | Number average particle diameter (nm) | Specific surface area ($m^2/g$) | Total pore volume (ml/g) | Average pore diameter (nm) |
|---|---|---|---|---|
| A | 18 | 3,206 | 0.82 | 3 |
| B | 35 | 2,351 | 0.88 | 5 |
| C | 85 | 2,077 | 0.86 | 4 |
| D | 120 | 2,024 | 0.75 | 7 |
| E | 156 | 1,853 | 0.70 | 6 |
| F | 210 | 1,153 | 0.81 | 6 |
| G | 245 | 1,108 | 0.75 | 9 |

Preparation of Carrier

A coating liquid is prepared by dispersing 3 parts of a carbon black (from Cabot Corporation) and 200 parts of a silicone resin solution (from Shin-Etsu Chemical Co., Ltd.) in toluene. The coating liquid is applied to the surface of a ferrite core material in an amount of 2,500 parts by a fluidized-bed spraying method. The ferrite core material thus covered with the coating liquid is baked in an electric furnace for 2 hours at 300° C. The resulting bulk carrier including particles having a particle diameter of 30 to 60 μm is sieved with a 63-μm mesh and subsequently a 45-μm mesh. Thus, a carrier having an average particle diameter of 35 μm is prepared.

Toner and Developer Example 1

First, 100 parts of the mother particle A and 0.75 parts of an isobutyl-treated hydrophobized rutile-type titanium oxide having an average particle diameter of 15 nm are mixed by a HENSCHEL MIXER while setting the peripheral speed of agitation blades to 35 m/sec. Next, 0.8 parts of a hexamethyldisilazane-treated hydrophobized silica having an average particle diameter of 8 nm are mixed therein by a HENSCHEL MIXER while setting the peripheral speed of agitation blades to 35 m/sec. Next, 0.5 parts of the hydroxyapatite silica complex porous particle A are mixed therein by a HENSCHEL MIXER while setting the peripheral speed of agitation blades to 35 m/sec. Thus, a toner A is prepared.

Further, a developer A is prepared by mixing 7 parts of the toner A and 93 parts of the carrier.

Toner and Developer Example 2

First, 100 parts of the mother particle A and 1.0 part of a hexamethyldisilazane-treated hydrophobized silica having an average particle diameter of 12 nm are mixed by a HENSCHEL MIXER while setting the peripheral speed of agitation blades to 35 m/sec. Next, 0.5 parts of the hydroxyapatite silica complex porous particle B are mixed therein by a HENSCHEL MIXER while setting the peripheral speed of agitation blades to 35 m/sec. Thus, a toner B is prepared.

Further, a developer B is prepared by mixing 7 parts of the toner B and 93 parts of the carrier.

Toner and Developer Example 3

First, 100 parts of the mother particle A and 0.75 parts of an isobutyl-treated hydrophobized rutile-type titanium oxide having an average particle diameter of 15 nm are mixed by a HENSCHEL MIXER while setting the peripheral speed of agitation blades to 35 m/sec. Next, 1.2 parts of a hexamethyldisilazane-treated hydrophobized silica having an average particle diameter of 20 nm are mixed therein by a HENSCHEL MIXER while setting the peripheral speed of agitation blades to 35 m/sec. Next, 0.75 parts of the hydroxyapatite silica complex porous particle C are mixed therein by a HENSCHEL MIXER while setting the peripheral speed of agitation blades to 35 m/sec. Thus, a toner C is prepared.

Further, a developer C is prepared by mixing 7 parts of the toner C and 93 parts of the carrier.

Toner and Developer Example 4

First, 100 parts of the mother particle A and 1.0 part of an isobutyl-treated hydrophobized rutile-type titanium oxide having an average particle diameter of 15 nm are mixed by a HENSCHEL MIXER while setting the peripheral speed of agitation blades to 35 m/sec. Next, 0.8 parts of a hexamethyldisilazane-treated hydrophobized silica having an average particle diameter of 12 nm are mixed therein by a HENSCHEL MIXER while setting the peripheral speed of agitation blades to 35 m/sec. Next, 0.75 parts of the hydroxyapatite silica complex porous particle D are mixed therein by a HENSCHEL MIXER while setting the peripheral speed of agitation blades to 35 m/sec. Thus, a toner D is prepared.

Further, a developer D is prepared by mixing 7 parts of the toner D and 93 parts of the carrier.

Toner and Developer Example 5

First, 100 parts of the mother particle B and 0.75 parts of an isobutyl-treated hydrophobized rutile-type titanium oxide having an average particle diameter of 15 nm are mixed by a HENSCHEL MIXER while setting the peripheral speed of agitation blades to 35 m/sec. Next, 0.8 parts of a hexamethyldisilazane-treated hydrophobized silica having an average particle diameter of 8 nm are mixed therein by a HENSCHEL MIXER while setting the peripheral speed of agitation blades to 35 m/sec. Next, 0.25 parts of the hydroxyapatite silica complex porous particle E are mixed therein by a HENSCHEL MIXER while setting the peripheral speed of agitation blades to 35 m/sec. Thus, a toner E is prepared.

Further, a developer E is prepared by mixing 7 parts of the toner E and 93 parts of the carrier.

Comparative Toner and Developer Example 1

First, 100 parts of the mother particle B and 1.2 parts of a hexamethyldisilazane-treated hydrophobized silica having an average particle diameter of 12 nm are mixed by a HENSCHEL MIXER while setting the peripheral speed of agitation blades to 35 m/sec. Next, 0.25 parts of the hydroxyapatite silica complex porous particle F are mixed therein by a HENSCHEL MIXER while setting the peripheral speed of agitation blades to 35 m/sec. Thus, a toner F is prepared.

Further, a developer F is prepared by mixing 7 parts of the toner F and 93 parts of the carrier.

Comparative Toner and Developer Example 2

First, 100 parts of the mother particle A and 1.0 part of an isobutyl-treated hydrophobized rutile-type titanium oxide having an average particle diameter of 15 nm are mixed by a HENSCHEL MIXER while setting the peripheral speed of agitation blades to 35 m/sec. Next, 0.8 parts of a hexamethyldisilazane-treated hydrophobized silica having an average particle diameter of 12 nm are mixed therein by a HENSCHEL MIXER while setting the peripheral speed of agitation blades to 35 m/sec. Next, 0.25 parts of the hydroxyapatite silica complex porous particle G are mixed therein by a HENSCHEL MIXER while setting the peripheral speed of agitation blades to 35 m/sec. Thus, a toner G is prepared.

Further, a developer G is prepared by mixing 7 parts of the toner G and 93 parts of the carrier.

Comparative Toner and Developer Example 3

First, 100 parts of the mother particle A and 1.0 part of a hexamethyldisilazane-treated hydrophobized silica having an average particle diameter of 20 nm are mixed by a HENSCHEL MIXER while setting the peripheral speed of agitation blades to 35 m/sec. Thus, a toner H is prepared.

Further, a developer H is prepared by mixing 7 parts of the toner H and 93 parts of the carrier.

Toner and Developer Example 6

First, 100 parts of the mother particle B and 0.8 parts of a hexamethyldisilazane-treated hydrophobized silica having an average particle diameter of 8 nm are mixed by a HENSCHEL MIXER while setting the peripheral speed of agitation blades to 35 m/sec. Next, 0.5 parts of the hydroxyapatite silica complex porous particle A are mixed therein by a HENSCHEL MIXER while setting the peripheral speed of agitation blades to 35 m/sec. Thus, a toner I is prepared.

Further, a developer I is prepared by mixing 7 parts of the toner 1 and 93 parts of the carrier.

Toner and Developer Example 7

First, 100 parts of the mother particle B and 1.2 parts of a hexamethyldisilazane-treated hydrophobized silica having an average particle diameter of 12 nm are mixed by a HENSCHEL MIXER while setting the peripheral speed of agitation blades to 35 m/sec. Next, 0.75 parts of the hydroxyapatite silica complex porous particle C are mixed therein by a HENSCHEL MIXER while setting the peripheral speed of agitation blades to 35 m/sec. Thus, a toner J is prepared.

Further, a developer J is prepared by mixing 7 parts of the toner J and 93 parts of the carrier.

Toner and Developer Example 8

First, 100 parts of the mother particle B and 0.75 parts of an isobutyl-treated hydrophobized rutile-type titanium oxide having an average particle diameter of 15 nm are mixed by a HENSCHEL MIXER while setting the peripheral speed of agitation blades to 35 m/sec. Next, 0.8 parts of a hexamethyldisilazane-treated hydrophobized silica having an average particle diameter of 12 nm are mixed therein by a HENSCHEL MIXER while setting the peripheral speed of agitation blades to 35 m/sec. Next, 0.75 parts of the hydroxyapatite silica complex porous particle D are mixed therein by a HENSCHEL MIXER while setting the peripheral speed of agitation blades to 35 m/sec. Thus, a toner K is prepared.

Further, a developer K is prepared by mixing 7 parts of the toner K and 93 parts of the carrier.

Comparative Toner and Developer Example 4

First, 100 parts of the mother particle B and 1.0 part of a hexamethyldisilazane-treated hydrophobized silica having an average particle diameter of 20 nm are mixed by a HENSCHEL MIXER while setting the peripheral speed of agitation blades to 35 m/sec. Next, 0.25 parts of the hydroxyapatite silica complex porous particle F are mixed therein by a HENSCHEL MIXER while setting the peripheral speed of agitation blades to 35 m/sec. Thus, a toner L is prepared.

Further, a developer L is prepared by mixing 7 parts of the toner L and 93 parts of the carrier.

Comparative Toner and Developer Example 5

First, 100 parts of the mother particle B and 1.0 part of a hexamethyldisilazane-treated hydrophobized silica having an average particle diameter of 20 nm are mixed by a HENSCHEL MIXER while setting the peripheral speed of agitation blades to 35 m/sec. Thus, a toner M is prepared.

Further, a developer M is prepared by mixing 7 parts of the toner M and 93 parts of the carrier.

The above-prepared toners and developers are each set in an image forming apparatus (from Ricoh Co., ltd.) and subjected to the evaluations described later. The image forming apparatus includes a photoreceptor to bear an electrostatic latent image; a charging roller disposed in proximity to or in contact with the photoreceptor to uniformly charge the photoreceptor; an irradiator to irradiate the photoreceptor with light to form an electrostatic latent image thereon; a developing device to develop the electrostatic latent image into a toner image with the developer; a transfer belt to transfer the toner image from the photoreceptor onto a transfer paper; a cleaner to remove residual toner particles remaining on the photoreceptor; a neutralization lamp to remove residual charges remaining on the photoreceptor; and an optical sensor to control the voltage supplied from the charging roller and the toner concentration in the developer. The developing device is supplied with the toner from a toner supply device through a toner supply opening.

An image forming operation is as follows. First, the photoreceptor starts rotating counterclockwise. The photoreceptor is neutralized by light so as to have an average surface potential of 0 to −150 V. The photoreceptor is then charged by the charger so as to have a surface potential of about −1,000 V. The photoreceptor is further irradiated with light emitted from the irradiator so that the irradiated area (i.e., image area) has a surface potential of 0 to −200 V.

The developing device supplies the toner to the image area from the developing sleeve. A paper feed part feeds a sheet of the transfer paper onto the transfer belt so that a leading edge of the sheet coincides with a leading edge of the toner image having been conveyed by rotation of the photoreceptor. As a result, the toner image is transferred from the photoreceptor onto the sheet on the transfer belt. The toner image is fixed on the sheet upon application of heat and pressure in a fixer. The sheet having the fixed toner image is discharged from the image forming apparatus. Residual toner particles remaining on the photoreceptor are removed by a cleaning blade in the cleaner. Subsequently, residual charges remaining on the photoreceptor are neutralized by the neutralization lamp. Thus, the photoreceptor gets ready for a next image forming operation.

The above-prepared toners and developers are subjected to the following evaluations. The evaluation results are shown in Table 2.

TABLE 2

| Examples | Hydroxy-apatite Silica Complex Porous Particle | Scratch on Photo-receptor | Image Quality | Abrasion of Photo-receptor | Discharge Product Remov-ability |
|---|---|---|---|---|---|
| Example 1 | A | A | A | A | A+ |
| Example 2 | B | A | A | A | A+ |
| Example 3 | C | A | A | A | A |
| Example 4 | D | A | A | A | A |
| Example 5 | E | B | A | A | B |
| Comparative Example 1 | F | C | A | B | B |
| Comparative Example 2 | G | C | B | C | C |
| Comparative Example 3 | N/A | A | A | A | C |
| Example 6 | A | A | A | B | A+ |
| Example 7 | C | A | A | A | A |
| Example 8 | D | A | A | A | A |
| Comparative Example 4 | F | B | A | B | C |
| Comparative Example 5 | N/A | A | A | A | C |

(1) Scratch on Photoreceptor

After the image forming apparatus continuously produces an image having a density of 4% on 100,000 sheets of paper, the photoreceptor is visually observed to determine whether scratch is made thereon or not and graded as follows.

A: No scratch or slight scratch is observed. Commercially viable.

B: Scratch is observed but the resulting image is good. Commercially viable.

C: Irreversible scratch is observed or the resulting image is defective. Commercially inviable.

(2) Image Quality

Image quality is comprehensively evaluated from two points: the degrees of defective transfer and background fouling. The degree of defective transfer is determined by visually observing a black solid image which is produced after an image is continuously produced on 5,000 sheets of paper. The degree of background fouling is determined by quantifying toner particles present on the photoreceptor during development of a white solid image, after an image is continuously produced on 5,000 sheets of paper. Specifically, the development of a white solid image is interrupted and toner particles present on the photoreceptor are transferred onto SCOTCH tape (from Sumitomo 3M). The SCOTCH tape having the toner particles is subjected to a measurement of image density by a spectrodensitometer (from X-Rite). When the image density difference between a blank SCOTCH tape is less than 0.30, the degree of background fouling is regarded as being low (good). When the image density difference between a blank SCOTCH tape is 0.30 or more, the degree of background fouling is regarded as being high (poor). Comprehensive image quality is graded into three ranks: A (good), B (acceptable), and C (poor).

(3) Abrasion of Photoreceptor

The thickness of the outermost layer of the photoreceptor is measured by an eddy current film thickness meter before and after a continuous image production on 100,000 sheets of paper. The degree of abrasion is determined from the abrasion depth (μm) being the thickness difference between before and after the image production, and graded as follows.

A: Good.

B: Acceptable. Commercially viable.

C: Unacceptable. Commercially inviable.

(4) Discharge Product Removability

After causing a 3-hour corona discharge (i.e., a 3-hour image forming operation), the image forming apparatus is powered off and the photoreceptor and the charging grid are allowed to stand for 15 hours.

Thereafter, the image forming apparatus is powered on again and a halftone image is continuously produced on 100 sheets of paper. The produced images are evaluated whether the image density is non-uniform or not at a portion immediately below the corona charger. Discharge product removability is graded as follows.

A+: Image density non-uniformity at immediately below the corona charger disappears while producing the halftone image on the 1st to 10th sheet.

A: Image density non-uniformity at immediately below the corona charger disappears while producing the halftone image on the 11th to 25th sheet.

B: Image density non-uniformity at immediately below the corona charger disappears while producing the halftone image on the 26th to 50th sheet.

C: B: Image density non-uniformity at immediately below the corona charger does not disappear until the halftone image is produced on the 51st sheet or later.

The toner including the hydroxyapatite silica complex porous particle according to an embodiment prevents the occurrence of various undesired phenomena on the photoreceptor. Specifically, the hydroxyapatite silica complex porous particle according to an embodiment has a proper particle diameter so as not to excessively scratch or abrade the photoreceptor.

What is claimed is:

1. A toner, comprising:

a mother particle, the mother particle including a binder resin and a release agent; and an external additive covering a surface of the mother particle, the external additive including a hydroxyapatite silica complex porous particle having a number average particle diameter of 160 nm or less.

2. The toner according to claim 1, wherein the toner is prepared by a method comprising:

dissolving or dispersing toner components in an organic solvent to prepare a toner components liquid, the toner components including the binder resin or a precursor thereof and the release agent;

dispersing the toner components liquid in an aqueous medium to prepare an emulsion;

removing the organic solvent from the emulsion to prepare the mother particle; and covering a surface of the mother particle with the external additive.

3. The toner according to claim 2, wherein the binder resin includes:

a modified polyester having an ester bond and another chemical bond; and a crystalline polyester.

4. The toner according to claim 3, wherein the precursor is capable of producing the modified polyester, the precursor including:

a compound having an active hydrogen group; and a polyester having a functional group reactive with the active hydrogen group.

5. The toner according to claim 3, wherein the modified polyester includes an ester bond and a urea bond.

6. The toner according to claim 3, wherein the crystalline polyester has a long axis dispersion diameter of 0.2 to 3 μm and a ratio of the long axis dispersion diameter to a short axis dispersion diameter is 3 or more.

7. The toner according to claim 3, wherein the crystalline polyester has an endothermic peak temperature of 50 to 150° C. measured by differential scanning calorimetry.

8. The toner according to claim 3, wherein the crystalline polyester is prepared by reacting an alcohol with an acid, the alcohol being at least one member selected form the group consisting of 1,4-butanediol, 1,6-hexanediol, 1,8-octanediol, 1,10-decanediol, and 1,12-dodecanesiol, and the acid being at least one member selected from the group consisting of fumaric acid, 1,4-butanedioic acid, 1,6-hexanedioic acid, 1,8-octanedioic acid, 1,10-decanedioic acid, and 1,12-dodecanedioic acid.

9. The toner according to claim 1, wherein the toner includes the hydroxyapatite silica complex porous particle in an amount of 0.1 to 5% by weight based on a total weight of the mother particle.

10. The toner according to claim 1, wherein the mother particle has a volume average particle diameter (Dv) of not less than 3.0 μm and less than 6.0 μm.

11. The toner according to claim 1, wherein a ratio (Dv/Dn) of a volume average particle diameter (Dv) to a number average particle diameter (Dn) of the mother particle is between 1.05 and 1.25.

12. A one-component developer, comprising the toner according to claim 1 and no carrier.

13. A two-component developer, comprising the toner according to claim 1 and a carrier.

14. A method of producing toner, comprising:

dissolving or dispersing toner components in an organic solvent to prepare a toner components liquid, the toner components including a binder resin or a precursor thereof and a release agent;

dispersing the toner components liquid in an aqueous medium to prepare an emulsion;

removing the organic solvent from the emulsion to prepare a mother particle; and covering a surface of the mother particle with an external additive, the external additive including a hydroxyapatite silica complex porous particle having a number average particle diameter of 160 nm or less.

* * * * *